United States Patent [19]

Simmons et al.

[11] 4,334,460

[45] Jun. 15, 1982

[54] CAP FOR A CHIMNEY

[75] Inventors: John J. Simmons, Cleveland; Douglas W. Hutson, Englewood, both of Tenn.

[73] Assignee: Giles Arthur Ellis, Cleveland, Tenn.; a part interest

[21] Appl. No.: 156,126

[22] Filed: Jun. 3, 1980

[51] Int. Cl.[3] ..... F23L 17/02

[52] U.S. Cl. ..... 98/83; 98/67

[58] Field of Search ..... 98/66 R, 67, 83, 84, 98/85, 86, 122

[56] References Cited

U.S. PATENT DOCUMENTS

| | | | |
|---|---|---|---|
| 841,660 | 1/1907 | Barnes | 98/83 X |
| 920,763 | 5/1909 | Lauritzeh | 98/83 |
| 1,542,740 | 6/1925 | Spillman | 98/66 R |
| 2,755,730 | 7/1956 | Douty | 98/67 |
| 2,976,796 | 3/1961 | Anthony et al. | 98/67 |
| 3,345,932 | 10/1967 | Sauer | 98/83 |
| 3,855,910 | 12/1974 | Brinton et al. | 98/83 X |

FOREIGN PATENT DOCUMENTS

| | | | |
|---|---|---|---|
| 2635240 | 2/1978 | Fed. Rep. of Germany | 98/83 |

*Primary Examiner*—Albert J. Makay
*Assistant Examiner*—Harold Joyce
*Attorney, Agent, or Firm*—Lamont Johnston

[57] ABSTRACT

A cap for a chimney is provided. The cap comprises a heat resistant cover, having a topside and an underside, extending across the chimney in superposed and spaced relation thereto. A support means is attached to the underside of the cover for supporting the cover in superposed and predetermined spaced relation above the chimney. A plurality of adjustable detachable mounting means are attached to the support means for detachably mounting the cover to the chimney. The mounting means are adjustable to accommodate the opening in the chimney. A particular advantage of this cap is that it can be easily installed in variously sized chimneys, and is of simple and inexpensive construction. Additionally the cap has a novel heat resistant cover.

1 Claim, 2 Drawing Figures

CAP FOR A CHIMNEY

BACKGROUND OF THE INVENTION

1. Field of the Invention

This invention relates to chimney caps, and in particular to a chimney cap which is adjustable for variously sized chimneys and is of simple and inexpensive construction and has a novel heat resistant cover.

2. Prior Art

While caps for chimneys are well known in the art such have not been entirely satisfactory for various reasons, such as cumbersome, expensive construction, and/or difficulties in installation and maintenance.

Known caps for chimneys are exemplified by the following U.S. patents:

U.S. Pat. No. 841,660 to Barnes;
U.S. Pat. No. 1,719,846 to Matlevish;
U.S. Pat. No. 2,060,231 to Malone et al;
U.S. Pat. No. 2,605,693 to Hansen;
U.S. Pat. No. 2,660,106 to Gray;
U.S. Pat. No. 2,918,859 to Boger;
U.S. Pat. No. 3,101,039 to Duchene et al;
U.S. Pat. No. 3,921,509 to Curry et al; and
U.S. Pat. No. 4,020,754 to Dalsin et al.

Generally all of these known caps for chimneys suffer in that they are generally complicated in structure and difficult to install. One of the primary reasons for this difficulty in installation is the fact that chimneys come in various sizes, primarily dependent on the type house construction and the size of the fireplace below. Thus a particular cap must be specifically designed for a particular chimney. Some of the aforementioned caps have detachable mounting means provided, however these detachable mounting means depend generally on the close tolerances between the cap and the chimney, see for example Hansen and Gray. Other known caps have mounting means which are adjustable to various size chimneys, see for example Barnes and Curry et al, however the mechanism for adjustment is comparatively complicated and difficult to utilize.

OBJECTS AND SUMMARY OF THE INVENTION

It is an object of this invention to provide a chimney cap which is simple in construction and inexpensive, and which can be detachably mounted to chimneys of various sizes.

It is a further object of this invention to provide a chimney cap which has a novel heat resistant cover not taught or suggested by the prior art.

These and other objects are accomplished in the present invention by a cap for a chimney comprising:

(a) a heat resistant cover having a topside and an underside extending across the chimney in superposed and spaced relation thereto;

(b) a support means attached to the underside of the cover for supporting the cover in superposed and predetermined spaced relation above the chimney;

(c) a plurality of adjustable detachable mounting means attached to the support means for detachable mounting the cover to the chimney, said mounting means being adjustable to accommodate the opening in the chimney.

BRIEF DESCRIPTION OF THE DRAWING

The invention will be more readily understood from a reading of the following specification and by reference to the accompanying drawing forming a part thereof, wherein an example of the invention is shown and wherein.

DESCRIPTION OF THE PREFERRED EMBODIMENT

Figure 1:
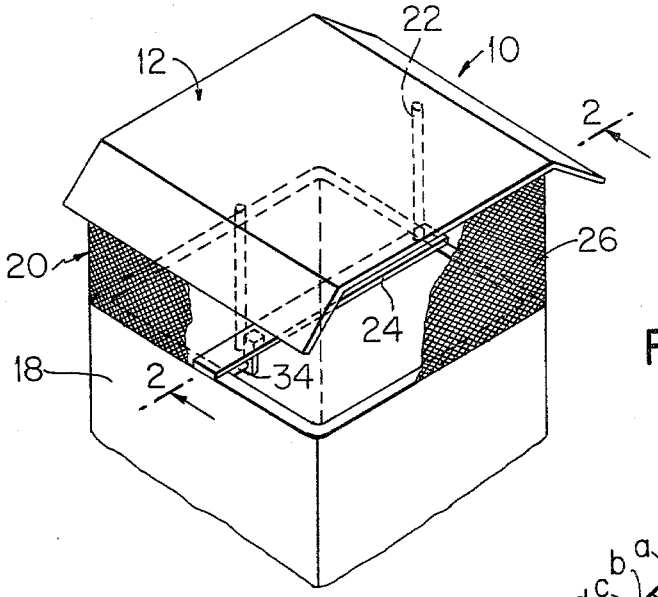
FIG. 1 is a perspective view of an embodiment of the chimney cap of this invention.
Figure 2:
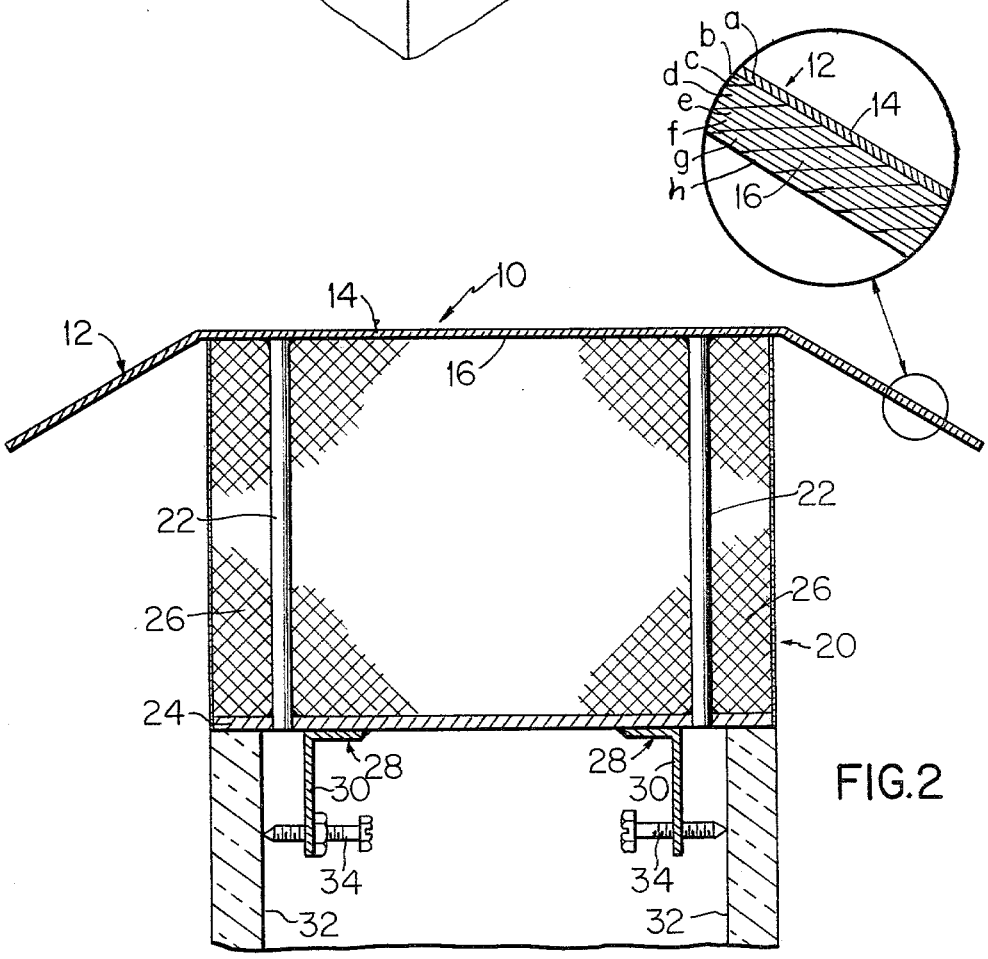
FIG. 2 is a sectional view of the chimney cap taken along line 2—2 of FIG. 1, including a blow-up of the novel heat resistant cover.

FIGS. 1 and 2 describe a preferred embodiment of this invention. Generally, the chimney cap is designated (10). The cap (10) is comprised of a heat resistant cover (12) having a topside (14) and an underside (16). The cover (12) extends across the chimney (18) in superposed and spaced relation thereto.

Preferably the cover is comprised of a plurality of heat resistant layers, and preferably the layers are constructed of a fiber reinforced plastic. A particularly preferred cover (12) is depicted in the blow-up shown in FIG. 2 and, from the topside (14) to the underside (16), has the following structure:

(a) a gelatinous heat resistant layer,
(b) a heat resistant polyester resin containing antimony trioxide (HETRON 197 AT from Ashland Chemical Inc.)
(c) fiberglass reinforced mat,
(d) a heat resistant polyester resin containing antimony trioxide,
(e) fiberglass reinforced mat,
(f) a heat resistant polyester resin containing antimony trioxide,
(g) a ceramic fiber, and
(h) a heat resistant polyester resin containing antimony trioxide.

This particular cover (12) is particularly suitable for conditions associated with the normal residential chimney to a fireplace, in that it is resistant to the weathering elements and the heat transferred to the chimney.

The support means, generally designated (20) is attached to the underside (16) of cover (12). The support means (20) is used for supporting the cover (12) in superposed and predetermined spaced relation above the chimney (18).

Preferably, as indicated in FIGS. 1 and 2, the support means (20) comprises two substantially parallel support members (22). Each member (22) is attached to the underside (16) of cover (12) near its center on opposite sides of the chimney (18) and to a bar (24) at the other end. These support members (22) are of a predetermined length (e.g. six inches) and support the cover (12) in superposed and predetermined spaced relation above the chimney (18). The bar (24) rests upon the chimney (18) supporting the cap (10) on the chimney.

Preferably a screen (26) surrounds the support means (20). The purpose of the screen (26) is to allow passage of the flue gases outward while not permitting the passage of leaves, birds, etc. into the chimney. The screen (26) may be constructed of any conventional screening capable of resisting the temperature and weathering conditions found under such circumstances, and having openings of a suitable size.

A plurality of adjustable detachable mounting means, generally designated (28), are attached to the support means (20), preferably to bar (24). The mounting means (28) detachably mount the cap (10) to the chimney (18).

The mounting means (28) are adjustable to accommodate various size chimney openings.

As indicated in FIG. 2, a particularly preferred mounting means (28) is comprised of a downward projecting lip (30) in spaced relation to the inner wall (32) of chimney (18). A threaded member (34) is threadably mounted to the lip (30). The threaded member (34) is long enough so that one end can bear against the inner wall (32) of chimney (18). Preferably, two mounting means (28) are juxtaposed opposite each other. Thus when the threaded member (34) is turned so that the end bears against the inner wall (32), the plurality of mounting means (28) securely mount the cap (10) onto the chimney (18). As can be seen such preferred mounting means (28) can accommodate variously sized chimneys. All that is required is that the bar (24) be of a greater length than the width of chimney (18) and that the threaded member (34) be of sufficient length to pass through lip (30) and bear upon inner wall (32).

Preferably, as indicated in FIGS. 1 and 2, there are two mounting means (28), each mounted substantially at or near the center of opposite side walls of the chimney (18).

In use, one places the chimney cap (10) on top of the chimney (18), the bar (24) supporting the cap (10). The threaded members (34) are then tightened and the cap (10) is thus securely mounted to the chimney (18).

While a preferred embodiment of the invention has been described using specific terms such description is for illustrative purposes only and it is to be understood that changes and variations may be made without departing from the spirit or scope of the following claims.

What is claimed is:

1. A cap for a chimney comprising:

a heat resistant cover having a topside and an underside extending across the chimney in superposed and spaced relation thereto;

a support means attached to the underside of the cover for supporting the cover in superposed and predetermined spaced relation above the chimney;

a plurality of adjustable detachable mounting means attached to the support means for detachably mounting the cover to the chimney, said mounting means being adjustable to accommodate the opening in the chimney, the cover comprising heat resistant layers, from the topside to the underside:

(a) a gelatinous heat resistant layer, (b) a heat resistant polyester resin containing antimony trioxide, (c) a fiberglass reinforced mat, (d) a heat resistant polyester resin containing antimony trioxide, (e) a fiberglass reinforced mat, (f) a heat resistant polyester resin containing antimony trioxide, (g) a ceramic fiber, and (h) a heat resistant polyester resin containing antimony trioxide.

* * * * *